US007780372B2

(12) United States Patent
Fattori et al.

(10) Patent No.: US 7,780,372 B2
(45) Date of Patent: Aug. 24, 2010

(54) FLOW RESTRICTING MEMBER

(75) Inventors: James G. Fattori, Trevose, PA (US); Francis E. Loftus, Richboro, PA (US); Benjamin N. Steltzer, Belmar, NJ (US)

(73) Assignee: LMT Mercer Group Inc., Lawrenceville, NJ (US)

( * ) Notice: Subject to any disclaimer, the term of this patent is extended or adjusted under 35 U.S.C. 154(b) by 475 days.

(21) Appl. No.: 11/899,851

(22) Filed: Sep. 7, 2007

(65) Prior Publication Data

US 2009/0067922 A1 Mar. 12, 2009

(51) Int. Cl.
*E01C 11/24* (2006.01)

(52) U.S. Cl. ..... 404/2; 404/4

(58) Field of Classification Search ..... 404/2, 404/4; 405/36, 43–45
See application file for complete search history.

(56) References Cited

U.S. PATENT DOCUMENTS

| | | | |
|---|---|---|---|
| 232,948 | A | 10/1880 | Dernham |
| 374,393 | A | 12/1887 | Campbell |
| 440,067 | A | 11/1890 | Smith |
| 468,714 | A | 2/1892 | Whitten |
| 505,130 | A | 9/1893 | Ryan |
| 506,267 | A | 10/1893 | Sefton |
| 642,530 | A | 1/1900 | Robertson |
| 672,868 | A | 4/1901 | Banwell |
| 693,511 | A | 2/1902 | Garrett et al. |
| 783,556 | A | 2/1905 | Van Buskirk |
| 1,245,903 | A | 11/1917 | Gross |
| 1,473,551 | A | 11/1923 | Gshwind |
| 1,479,651 | A | 1/1924 | Clements |
| 1,711,674 | A | 5/1929 | Egan |
| 2,159,752 | A | 5/1939 | Shaw |
| 2,473,279 | A | 6/1949 | Crocker |
| 3,788,756 | A | 1/1974 | Ito |
| 3,881,832 | A | 5/1975 | Maguire |
| 3,957,383 | A | 5/1976 | Fredericks |
| 4,046,482 | A | 9/1977 | Paasch |
| 4,594,157 | A | 6/1986 | McGowan |
| 4,610,566 | A | 9/1986 | Albang et al. |
| 5,232,587 | A | 8/1993 | Hegemier et al. |
| 5,345,741 | A | 9/1994 | Slater et al. |
| 5,403,474 | A | 4/1995 | Emery |
| 5,632,888 | A | 5/1997 | Chinn et al. |
| 5,702,595 | A | 12/1997 | Mossburg, Jr. |
| 5,954,952 | A | 9/1999 | Strawser, Sr. |
| 6,010,622 | A | 1/2000 | Chinn et al. |
| 6,015,489 | A | 1/2000 | Allen et al. |

(Continued)

*Primary Examiner*—Raymond W Addie
(74) *Attorney, Agent, or Firm*—Sperry, Zoda & Kane

(57) ABSTRACT

A device for restricting flow through a curb inlet opening defined in a street storm drain by secure positioning a face plate extending thereover. Multiple flow slots are defined extending through the face plate to allow limited flow therethrough. The face plate is securable to the drain by mounting apparatus which includes one or more mounting brackets along with an engagement device attachable to the flow limiting slots and the brackets to hold the face plate in position extending over the curb inlet opening. Mounting brackets can have teeth for engaging storm drain for enhanced securement therewith. The flow restricting slots are preferably radially arranged with respect to one another and can include lateral slots further engageable with the mounting bracket to prevent rotation thereof during tightening thereof. Conical washers can extend over the head of mounting bolts for protection thereof.

35 Claims, 5 Drawing Sheets

U.S. PATENT DOCUMENTS 6,017,166 A 1/2000 Mossburg, Jr.
6,214,216 B1 4/2001 Isaacson
6,227,758 B1 5/2001 Missick et al.
6,402,942 B2 6/2002 Cardwell et al.
6,537,446 B1 3/2003 Sanguinetti
6,609,852 B2 8/2003 Wimberger
6,709,579 B1 3/2004 Singleton et al.
6,811,708 B2 11/2004 Shaw et al.
6,821,053 B2 11/2004 Martinez
6,824,677 B2 11/2004 Martinez
6,869,523 B2 3/2005 Martinez
6,869,526 B2 3/2005 Sharpless
6,884,343 B2 4/2005 Harris et al.
6,972,088 B2 12/2005 Yehuda
6,974,540 B1 12/2005 Fleischmann
6,997,636 B2 2/2006 Tremouilhac
7,005,060 B2 2/2006 Pitt et al.
7,052,207 B1 5/2006 Wimberger
7,070,691 B2 7/2006 Lindemulder
7,074,326 B2 7/2006 Singleton
7,128,495 B1 10/2006 Lill et al.
7,131,787 B2 11/2006 McGinn
7,132,045 B1 11/2006 Trangsrud
7,144,185 B2 12/2006 Messerschmidt et al.
7,156,987 B1 1/2007 Sanguinetti
7,160,048 B1 1/2007 Fattori et al.
7,179,371 B1 2/2007 Bistline
7,208,082 B2 4/2007 Hurst et al.
2007/0086856 A1 4/2007 Lill et al.

FLOW RESTRICTING MEMBER

BACKGROUND OF THE INVENTION

1. Field of the Invention

The herein described invention deals with the field of devices for restricting flow through curb inlet openings defined in street storm drains for minimizing the flow of contaminating articles and materials through municipal water drain conduits. The public cost for processing and cleaning water and other items that pass through curb inlet openings of street storm drains has become burdensome and needs to be addressed. As such, there is a desire currently to restrict the materials that can flow into such inlet curb inlet openings by limiting the size of flow openings thereinto. The present invention provides an improved construction for a face plate and mounting apparatus which together facilitate attaching of a flow restricting member in position extending over curb inlet openings defined in street storm drains to restrict the flow of materials therein such as bottles, trash, toys and, most particularly, limit accesses therein by children and other unwanted persons. The mounting apparatus of the present invention includes a mounting bracket and an engagement means which can quickly, easily and reliably secure the face plate with respect to the street storm drain in the area thereof immediately surrounding a curb inlet opening for restricting flow and access thereinto by making use of the flow openings defined in the face plate for facilitating mounting thereof.

2. Description of the Prior Art

Other prior art devices utilizing alternative constructions have been disclosed for the purpose of restricting access or flow into storm drains in various issued patents such as disclosed in U.S. Pat. No. 232,948 patented Oct. 5, 1880 to F. Dernham on a "Sewer"; and U.S. Pat. No. 374,393 patented Dec. 6, 1887 to G. G. Campbell on a "Catch Basin Cover"; and U.S. Pat. No. 440,067 patented Nov. 4, 1890 to R. Smith and Assignor of One-Half to George W. Strange on a "Catch-Basin Top And Trap"; and U.S. Pat. No. 468,714 patented Feb. 9, 1892 to W. M. Whitten on a "Cover For Catch Basins"; and U.S. Pat. No. 505,130 patented Sep. 19, 1893 to T. J. Ryan on a "Receiver And Stench Trap"; and U.S. Pat. No. 506,267 patented Oct. 10, 1893 to W. E. Sefton and assigned to Sherlock, Elmer & Sherlock on a "Sewer-Basin Trap"; and U.S. Pat. No. 642,530 patented Jan. 30, 1900 to G. A. Robertson on a "Catch Basin"; and U.S. Pat. No. 672,868 patented Apr. 23, 1901 to J. Banwell and assigned to C. W. Nokes and George Caunter on a "Casing And Cover For Catch-Basins"; and U.S. Pat. No. 693,511 patented Feb. 18, 1902 to W. H. Garrett & H. C. Pauly and assigned to Hennessy Foundry Company on a "Sewer-Inlet"; and U.S. Pat. No. 783,556 patented Feb. 28, 1905 to R. M. Van Buskirk on a "Catch Basin Top"; and U.S. Pat. No. 1,245,903 patented Nov. 6, 1917 to E. G. Gross on a "Sewer-Trap Cap"; and U.S. Pat. No. 1,473,551 patented Nov. 6, 1923 to L. Gschwind on a "Direct Sewer Inlet"; and U.S. Pat. No. 1,479,651 patented Jan. 1, 1924 to E. G. Clements on a "Device For Marking Parking Limits For Vehicles"; and U.S. Pat. No. 1,711,674 patented May 7, 1929 to G. F. Egan on a "Sewer Construction"; and U.S. Pat. No. 2,159,752 patented May 23, 1939 to E. W. Shaw and assigned to The France Foundry & Machine Co. on a "Curb Inlet"; and U.S. Pat. No. 2,473,279 patented Jun. 14, 1949 to De Witt S. Crocker on a "Curb Inlet Casting"; and U.S. Pat. No. 3,788,756 patented Jan. 29, 1974 to S. Ito on a "Curb And Drain Unit"; and U.S. Pat. No. 3,881,832 patented May 6, 1975 to H. A. Maguire on a "Low Profile Protective Insert For Sewers"; and U.S. Pat. No. 3,957,383 patented May 18, 1976 to R. H. Fredericks on a "Curb Protection Device And Method"; and U.S. Pat. No. 4,046,482 patented Sep. 6, 1977 to H. R. Paasch on a "Protective Cover For Sewer Grates"; and U.S. Pat. No. 4,594,157 patented Jun. 10, 1986 to B. J. McGowan on an "Inlet Clamp And Screen"; and U.S. Pat. No. 4,610,566 patented Sep. 9, 1986 to N. P. Albang et al and assigned to Phoenix Simpton Company on a "Curb Inlet With Removable Gutter Form"; and U.S. Pat. No. 5,232,587 patented Aug. 3, 1993 to T. E. Hegemier et al and assigned to Tom Hegemier on a "Stormwater Inlet Filter"; and U.S. Pat. No. 5,345,741 patented Sep. 13, 1994 to H. O. Slater et al and assigned to J. & H. Slater Construction Co., Inc. on a "Silt Blockage For Catch Basins"; and U.S. Pat. No. 5,403,474 patented Apr. 4, 1995 to G. R. Emery on a "Curb Inlet Gravel Sediment Filter"; and U.S. Pat. No. 5,632,888 patented May 27, 1997 to A. W. Chinn et al and assigned to Dandy Enterprises Limited on an "Environmental Filter"; and U.S. Pat. No. 5,702,595 patented Dec. 30, 1997 to W. H. Mossburg, Jr. on a "Catch Basin Guard"; and U.S. Pat. No. 5,954,952 patented Sep. 21, 1999 to D. M. Strawser and assigned to Alpine Stormwater Management Company on a "Stormwater Catch Basin Filter Assembly"; and U.S. Pat. No. 6,010,622 patented Jan. 4, 2000 to A. W. Chinn et al and assigned to Dandy Enterprises Limited on an "Environmental Filter"; and U.S. Pat. No. 6,015,489 patented Jan. 18, 2000 to L. J. Allen et al and assigned to Larry J. Allen and Bridgett L. Allen on a "Plastic Self-Relieving Curb Inlet Fitler"; and U.S. Pat. No. 6,017,166 patented Jan. 25, 2000 to W. H. Mossburg, Jr. on a "Catch Basin Guard And Filter"; and U.S. Pat. No. 6,214,216 patented Apr. 10, 2001 to R. Isaacson on a "Drain Filter Support"; and U.S. Pat. No. 6,227,758 patented May 8, 2001 to G. J. Missick et al on a "Protector For Through-The-Curb Drain"; and U.S. Pat. No. 6,402,942 patented Jun. 11, 2002 to T. Cardwell et al on a "Catch Basin Curb Inlet Filter Assembly"; and U.S. Pat. No. 6,537,446 patented Mar. 25, 2003 to P. S. Sanguinetti and assigned to The Water Sweeper on a "Drainage Filter System For Debris And Contaminant Removal"; and U.S. Pat. No. 6,609,852 patented Aug. 26, 2003 to B. J. Wimberger and assigned to Brian J. Wimberger on a "Sediment Control Drain And Method Of Construction"; and U.S. Pat. No. 6,709,579 patented to E. R. Singleton et al on Mar. 23, 2004 and assigned to Silt-Saver, Inc. on a "Curb Inlet Filter"; and U.S. Pat. No. 6,811,708 patented Nov. 2, 2004 to M. D. Shaw et al and assigned to UltraTech International, Inc. on a "Curb Guard Filter"; and U.S. Pat. No. 6,821,053 patented Nov. 23, 2004 to A. Martinez on a "Water Flow Responsive Barrier For Gutters And Storm Drains With Rotary Actuator"; and U.S. Pat. No. 6,824,677 patented to A. Martinez on Nov. 330, 2004 on a "Curbside Trap For Pollutants And Solid Trash"; and U.S. Pat. No. 6,869,523 patented to A. Martinez on Mar. 22, 2005 on a "Curbside Drain Barrier For Detaining Solid Trash During No Or Slow Water Flow"; and U.S. Pat. No. 6,869,526 patented Mar. 22, 2005 to S. R. Sharpless on a "Storm Drain Filter Assembly"; and U.S. Pat. No. 6,884,343 patented Apr. 26, 2005 to J. E. Harris et al on a "Curb Inlet Catch Basin Filter"; and U.S. Pat. No. 6,972,088 patented Dec. 6, 2005 to L. H. Yehuda on a "Pivotal Gate For A Catch Basin Of A Storm Drain System"; and U.S. Pat. No. 6,974,540 patented Dec. 13, 2005 to C. R. Fleischmann on a "Street Curb Drain Filter"; and U.S. Pat. No. 6,997,636 patented Feb. 14, 2006 to R. Tremouilhac and assigned to Norinco on a "Device For Connecting A Piece Of Road Equipment, Such As Drain Inlet, To A Vertical Fixed Runoff Drainage Pipe"; and U.S. Pat. No. 7,005,060 patented Feb. 28, 2006 to R. E. Pitt et al and assigned to StormTrain LLC on an "Upflow Surface Water Runoff Filtration System"; and U.S. Pat. No. 7,052,207 patented May 30, 2006 to B. J. Wimberger on a "Sediment Control Drain And Method Of Construction"; and U.S. Pat.

No. 7,070,691 patented Jul. 4, 2006 to J. Lindemulder and assigned to BMP Supplies Inc. on a "Protector For Sewer System Inlet"; and U.S. Pat. No. 7,074,326 patented Jul. 11, 2006 to E. R. Singleton and assigned to Silt-Saver, Inc. on a "Curb-And-Grate Inlet Filter"; and U.S. Pat. No. 7,128,495 patented Oct. 31, 2006 to C. F. Lill et al on a "Curb Box Cover Assembly"; and U.S. Pat. No. 7,131,787 patented Nov. 7, 2006 to J. H. McGinn and assigned to Ertec Environmental Systems LLC on a "Drain Inlet Cover"; and U.S. Pat. No. 7,132,045 patented Nov. 7, 2006 to J. P. Transgrud and assigned to Trangsrud & Associates, Inc. on a "Sanitaly, Storm And Catch Basin Trap With Filter Insert"; and U.S. Pat. No. 7,7,144,185 patented Dec. 5, 2006 to H. Messerschmidt et al and assigned to ACO Severin Ahlmann GmbH & Co. KG on a "Street Grid For Surface Drainage"; and U.S. Pat. No. 7,156,987 patented Jan. 2, 2007 to P. S. Sanguinetti on a "Storm Drain Filter Device"; and U.S. Pat. No. 7,160,048 patented Jan. 9, 2007 to J. G. Fattori et al and assigned to LMT Mercer Group Inc. on a "Flow Restricting Member"; and U.S. Pat. No. 7,179,371 patented Feb. 20, 2007 to T. N. Bistline on a "Securable Curb Inlet Filter"; and U.S. Pat. No. 7,208,082 patented Apr. 24, 2007 to J. G. Hurst et al. and assigned to John G. Hurst on a "Drainage Water Filter For Erosion Control".

SUMMARY OF THE INVENTION

The present invention discloses a flow restricting member designed to be attachable to a street storm drain for positioning extending over a curb inlet opening defined in the drain. The flow restricting member includes a face plate preferably made of a weathering steel material which defines a plurality of flow slots therein which may be arranged in various means. One of the means of arrangement would be extending radially upwardly and outwardly at acute angles with respect to one another. The flow slots in the face plate define a restricted flow path through the face plate into the curb inlet opening. These flow slots also enhance the attachment of the face plate with respect to the street storm drain extending over and adjacent the curb inlet opening.

Preferably the face plate includes a rear surface facing the curb inlet opening and street storm drain when the face plate is secured thereto and a front surface facing away from the street storm drain and the curb inlet opening when the face plate is secured thereto. The surface of the face plate preferably is positioned facing approximately oppositely relative to the rear surface thereof. The flow restricting member further includes a mounting apparatus positionable extending through one or more of the flow slots for engagement with respect to the street storm drain immediately surrounding the curb inlet opening. The mounting apparatus is also engageable with respect to at least one of the flow slots defined in the face plate for retaining thereof in position extending over the curb inlet opening for restricting flow therethrough. The mounting apparatus preferably includes at least one mounting bracket which preferably is generally C-shaped and is positionable behind the face plate adjacent the rear surface. The mounting bracket includes a supporting section preferably which is engageable with respect to one of the flow slots defined in the face plate. The supporting section preferably includes a protruding tab adapted to extend into the flow slot of the face plate to facilitate engagement of the supporting section therewith. The supporting section of the mounting bracket is preferably capable of adjustable engagement with respect to any of the flow slots at a plurality of different locations therealong to facilitate attachment to street storm drains having various different sizes and configurations to thereby make this apparatus more universally usable. The mounting bracket further includes a securement section which is spatially disposed from the rear surface of the face plate to define therebetween a retaining zone for receiving and holding the street storm drain therewithin immediately surrounding the curb inlet opening defined therein to facilitate securement. The securement section can include optionally teeth therein to facilitate gripping of the street storm drain around the curb inlet opening defined therein. Optionally the mounting bracket can include an engagement section positioned between the supporting section and the securement section to facilitate mounting of the face plate to the street storm drain in position extending over the curb inlet opening defined therein. This engagement section when included can define a mounting aperture therewithin.

The mounting apparatus further includes an engagement means positioned extending through one of the flow slots of the face plate into engagement with the engagement section of the mounting bracket for urging the securement section thereof toward the rear surface of the face plate with the street storm drain surrounding the curb inlet opening positioned within the retaining zone for securement of the face plate with respect thereto. Each of the flow slots are capable preferably of maintaining restricted flow therethrough when one of the mounting brackets is positioned in engagement with the flow slot to facilitate mounting of the face plate to the street storm drain. Each of the engagement mechanisms preferably will include a fastener stud which can extend through one of the flow slots into engagement with respect to the mounting bracket to facilitate securement of the street storm drain immediately surrounding the curb inlet opening within the retaining zone. Each of the mounting apertures are adapted to receive one of the fastening studs extending thereinto in engagement therewith to facilitate securement between the engagement means and the mounting bracket. Furthermore each of the fastener studs preferably will include a security mechanism to minimize unauthorized disengagement thereof. The fastener stud preferably will include a fastener head to facilitate securement thereof and the engagement means will preferably include a conical washer defining a washer hole extending therethrough and an enlarged hole section thereadjacent. The washer hole is adapted to receive the fastener stud extending therethrough and said enlarged hole section thereof is adapted to extend around the fastener head for protection thereof adjacent the front surface of the face plate.

In a preferred configuration of the present invention the fastener stud is male threaded and the mounting aperture is female threaded and mated to the fastener stud threading to facilitate threaded engagement therebetween. It is also preferable that the face plate can include a first lateral end extending between the rear surface and the front surface of the face plate. This first lateral end is chamfered at an angle from the rear surface to the front surface laterally adjacent to the face plate. Similarly the face plate can include a second lateral edge extending between the rear surface and the front surface of the face plate and positioned oppositely from the first lateral end. This second end edge will preferably be chamfered at an angle from the rear surface to the front surface laterally adjacent to the face plate. The first lateral end and the second lateral end are preferably chamfered inwardly toward one another extending forwardly from the rear surface of the face plate to the front surface.

In another preferred configuration the face plate will define a lateral edge extending completely around the face plate. This lateral edge extends between the rear surface and the front surface thereof. The first lateral edge is chamfered angularly from the rear surface to the front surface laterally adjacent the face plate such that the rear surface is larger in surface area than the front surface.

In a preferred configuration of the present invention four individual mounting brackets are included each including a supporting section and a securement section and a retaining zone. The use of four such mounting brackets has been found to be the most convenient and efficient means of mounting of the face plate with respect to street storm drains in position extending over the curb inlet openings defined therein. Similarly the engagement means can include four individual engagement devices each separately securable with respect to each of the individual mounting brackets.

In an alternative configuration of the present invention one or more of the individual flow slot means are defined as a primary flow slot. With such primary flow slots they are of a lateral size smaller than the size of the supporting section of the mounting bracket and define a plurality of lateral slots therein. These lateral slots are large enough to receive the protruding tabs of the supporting section of the mounting apparatus extending thereinto to facilitate engagement of the supporting section with respect to the flow slots. Preferably each of these lateral slots defines a different location along the flow slot for defining a position of engagement of the supporting section of the mounting bracket therewith for facilitating attachment of the face plate with respect to the curb inlet openings of various different sizes and configurations. Each of the flow slots preferably include two such primary flow slots and preferably they are oriented extending laterally or horizontally.

Also it is preferably that a medallion be included detachably securable with respect to the face plate for displaying indicia and text thereon as needed. Also the face plate of the apparatus of the present invention is designed to receive indicia and text which can be displayed thereon by laser engraving as desired.

It is an object of the present invention to provide a flow restricting member particularly usable attached to a street storm drain for restricting flow into a curb inlet opening therein which includes flow apertures which can extend radially outwardly at acute angles with respect to one another.

It is an object of the present invention to provide a flow restricting member particularly usable attached to a street storm drain for restricting flow into a curb inlet opening therein which includes a mounting apparatus with an engagement means for securing a mounting bracket with respect to a face plate and the storm drain for securing them together.

It is an object of the present invention to provide a flow restricting member particularly usable attached to a street storm drain for restricting flow into a curb inlet opening therein which includes chamfered edges at various locations to minimize damage such as from snow plows or other vehicles when in use positioned over a street storm drain.

It is an object of the present invention to provide a flow restricting member particularly usable attached to a street storm drain for restricting flow into a curb inlet opening therein which includes protective conical washers extending around the heads of the mounting studs for protection thereof.

It is an object of the present invention to provide a flow restricting member particularly usable attached to a street storm drain for restricting flow into a curb inlet opening therein which has minimal capital costs.

It is an object of the present invention to provide a flow restricting member particularly usable attached to a street storm drain for restricting flow into a curb inlet opening therein which requires a minimum amount of maintenance.

It is an object of the present invention to provide a flow restricting member particularly usable attached to a street storm drain for restricting flow into a curb inlet opening therein which is made of weathering steel.

It is an object of the present invention to provide a flow restricting member particularly usable attached to a street storm drain for restricting flow into a curb inlet opening therein which includes a unique means of attachment extending through the flow slots defined therein.

It is an object of the present invention to provide a flow restricting member particularly usable attached to a street storm drain for restricting flow into a curb inlet opening therein which includes drain engaging teeth located on the mounting bracket to facilitate engagement of the mounting bracket with respect to the street storm drain itself in the area thereof immediately surrounding the curb inlet opening.

It is an object of the present invention to provide a flow restricting member particularly usable attached to a street storm drain for restricting flow into a curb inlet opening therein which can include tamperproof threaded bolts to prevent disengagement or removal thereof.

It is an object of the present invention to provide a flow restricting member particularly usable attached to a street storm drain for restricting flow into a curb inlet opening therein which includes engaging teeth on the mounting bracket designed to engage a street storm drain in the areas thereof immediately surrounding a curb inlet opening defined therein.

It is an object of the present invention to provide a flow restricting member particularly usable attached to a street storm drain for restricting flow into a curb inlet opening therein which firmly secures a face plate over the curb inlet opening utilizing tamperproof securement bolts.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
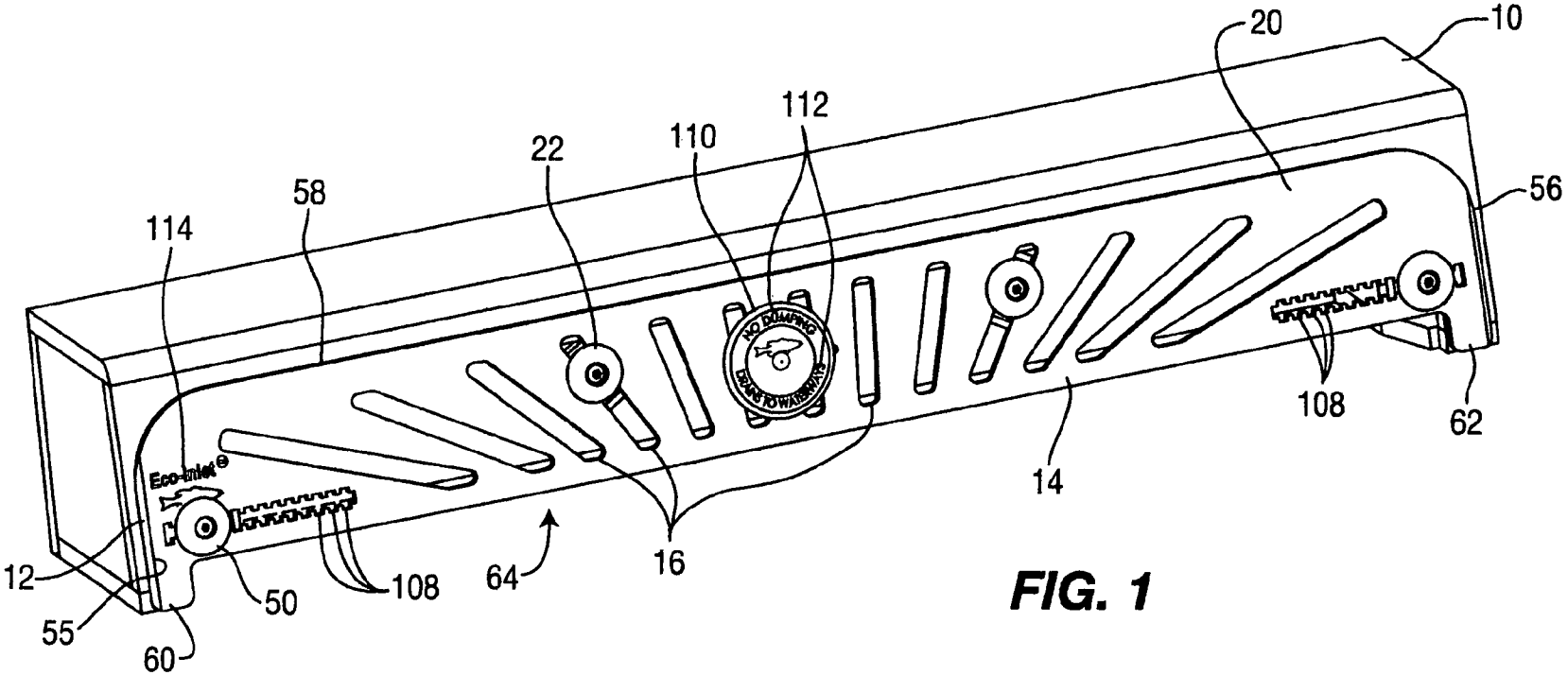
FIG. 1 is a front perspective illustration of an embodiment of the flow restricting member of the present invention shown in position secured to a street storm drain across a curb inlet opening therein held in place with a mounting apparatus including four mounting brackets and engagement means.
Figure 5:
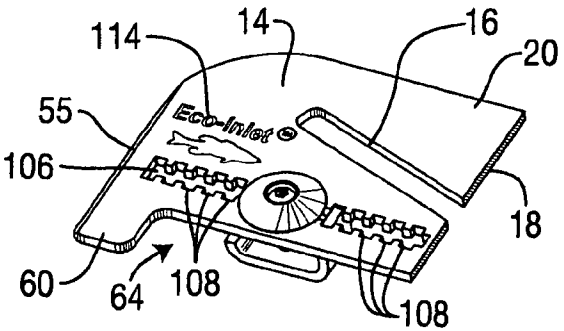
FIG. 5 is a close-up view of the lower left portion of the embodiment shown in FIG. 2.
Figure 4:
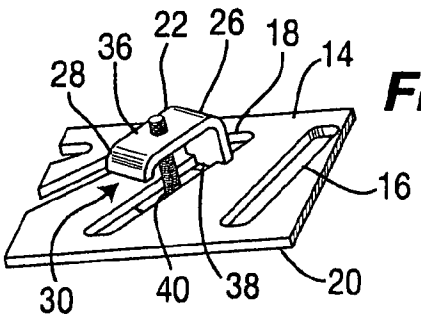
FIG. 4 is a close-up view of the central section of FIG. 3.

The present invention provides a flow restricting member comprising a face plate 14 defining a plurality of flow slots 16 therewithin. The face plate 14 is attachable with respect to a street storm drain 10 extending across the curb inlet opening 12 for controlling passage of materials thereinto. The flow slot 16 restricts the flow of fluids and other articles through the face plate 14 and therefore into the curb inlet opening 12.

The face plate 14 preferably includes a rear surface 18 facing the street storm drain 10 and a front surface 20 facing away therefrom. A mounting apparatus 22 is engageable with respect to the street storm drain 10 in the area thereof immediately surrounding the curb inlet opening 12 and is engageable with respect to one or more of the flow slots 16 of the face plate 14 for the purpose of securing the face plate 14 in position extending across and controlling flow into the curb inlet opening 12.

Each of the mounting brackets is preferably generally C-shaped and includes a supporting section 26 at one end thereof and a securement section 28 at the other end thereof. The supporting section 28 is adapted to engage one of the flow slots 16 defined in the face plate 12 and the securement section 28 is positioned in spaced relation relative to the rear surface 18 of the face plate 14 for defining therebetween a retaining zone 30 for receiving the edge of the street storm drain 10 immediately surrounding the curb inlet opening 12 therein for securement. The securement section 28 can be biased toward the rear surface 18 of the face plate 14 such as to be brought into abutment with the street storm drain 10 for gripping thereof by reducing the size of the retaining zone 30. Engagement between the securement section 28 of the mounting bracket 24 and the street storm drain 10 can be enhanced by the inclusion of one or more teeth 32 on the securement section 28 of the mounting bracket 24.

Tightening of the mounting bracket 24 with respect to the street storm drain 10 is achieved by the inclusion of an engagement means 34. This means can include an engagement bolt or fastener stud 40 which may be male threaded. This engagement means 34 or fastener stud 40 can be adapted to extend into a mounting aperture 40 defined in the mounting bracket 24. Preferably each mounting bracket 24 will include an engagement section 36 located preferably between supporting section 26 and securement section 28 for the purposes of facilitating engagement with respect to the fastener stud 40. This engagement is facilitated by forming the engagement section 36 such that it defines a mounting aperture means 42 therein which is threaded to match the threads of the fastener stud 50 to facilitate engagement therewith. Also the present invention includes conical washers 52.

Thus, with the construction shown in this embodiment, a fastener stud 40 is positioned extending through the washer hole 53 defined in the conical washer 52 and then extends through one of the flow slots 16 defined in the face plate 14 such that it extends further into threaded engagement with respect to a mounting aperture 42 defined in the engagement section 36 of a C-shaped mounting bracket 24. With this construction tightening of the fastener stud 40 will cause the supporting section 26 of the mounting bracket 24 to engage one of the flow slots 16 of the face plate 14 and will also cause the securement section 28 to be drawn toward the rear surface 18 of the face plate 14 thereby restricting the size of the retaining zone 30 and clamping the street storm drain 10 therewithin. The engagement of the supporting section 26 of the mounting bracket 24 with respect to one of the flow slots 16 is enhanced by the inclusion of a protruding tab 38 thereon which facilitates this securement and prevents any movement such as rotation of the mounting bracket 24 as the fastener stud 40 is tightened.

A security means 44 is included to prevent disengagement such as by tampering, theft or vandalism of the face plate 16 from the storm drain 10. This is provided by utilizing a fastener stud 40 which includes a security mechanism. In this embodiment the security mechanism includes a security pin 48 positioned within the allen wrench opening 46 of the head 50 of the fastener stud 40. Thus, once the fastener stud 40 is tightened, the security pin 48 will prevent loosening thereof with a rotating instrument having an allen wrench head.

It is also preferable that the heads 50 of the fasteners 40 be protected and this protection is provided by the conical washers 52. The washer hole 53 extending therethrough preferably includes an enlarged hole section 54 which is adapted to receive the fastener head 50 received completely therewithin. In this manner the heads of the fasteners are protected from lateral forces which can be caused by various items such as vehicle wheels, tires or snow plows which commonly are drawn across the front of such street storm drains 10 during normal maintenance.

Another means of protecting the apparatus of the present invention is to form the face plate 14 such that the first lateral end 55 thereof and the second lateral end 56 thereof are chamfered which will deflect items such as car wheels, tires or snow plows and minimize damaging of the face plate 14 during normal maintenance. In another configuration the entire outer periphery defined as the later edge 58 of the face plate 14 can be similarly chamfered for similar protection thereof.

In the embodiment shown in this invention the face plate 14 will include a first leg 60 and a second leg 62 spaced apart from one another and defining therebetween a lower open zone 64. This multiple leg configuration will facilitate stability despite the fact that many substrates such as streets or lower curb areas are not flat. The inclusion of two individual legs provides a stabilizing effect that accommodates higher areas or lower areas in the portion of the street or lower curb area between the spaced apart first and second legs 60 and 62 of the face plate 14.

Figure 2:
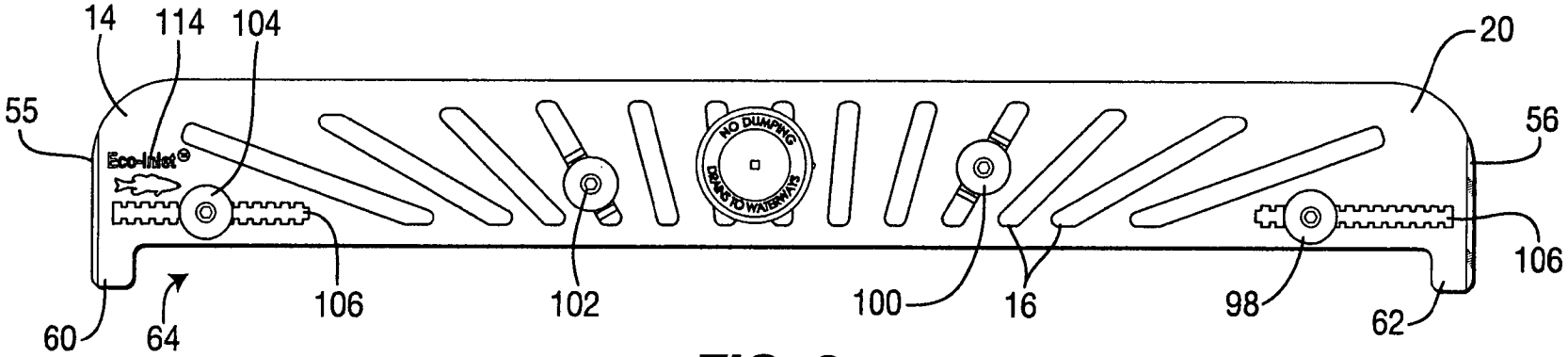
FIG. 2 is a front plan view of the embodiment shown in FIG. 1.
Figure 3:
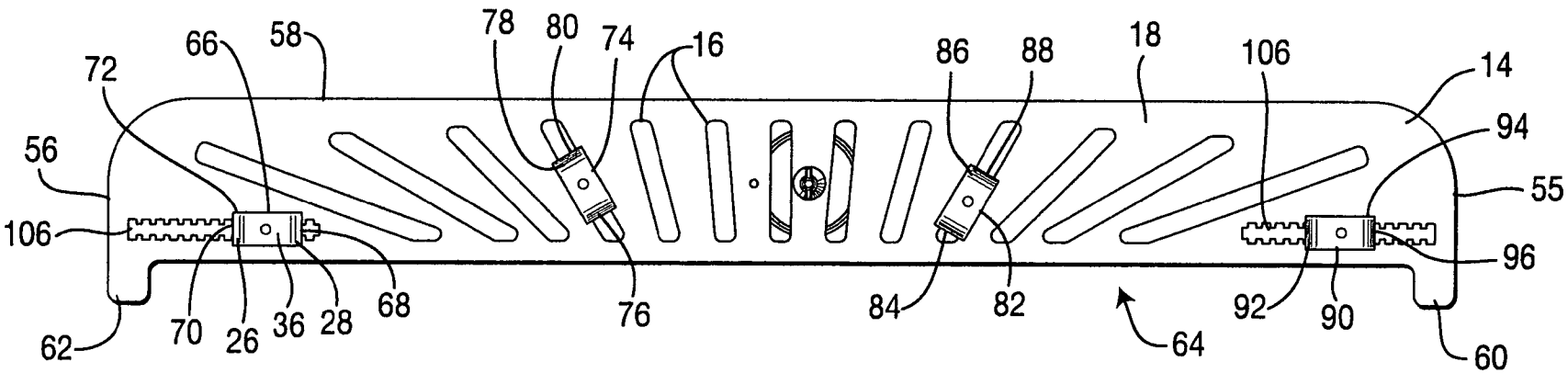
FIG. 3 is a rear plan view of the embodiment shown in FIG. 1.
Figure 6:
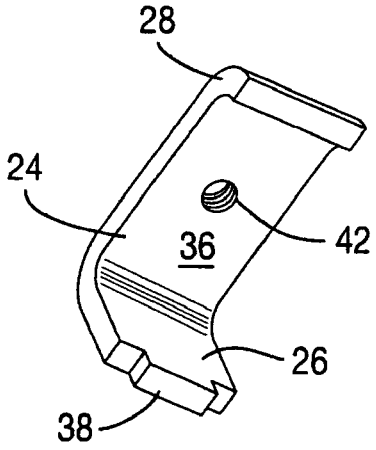
FIG. 6 is a perspective illustration of an embodiment of a mounting bracket of the present invention.
Figure 7:
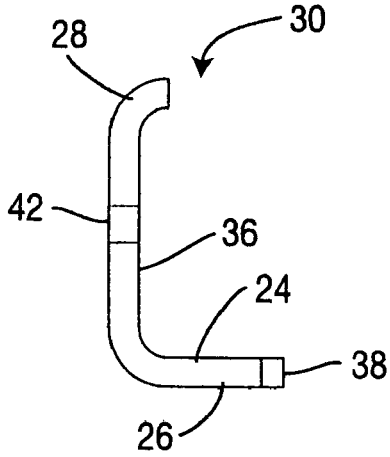
FIG. 7 is a side plan view of the embodiment shown in FIG. 6.
Figure 8:
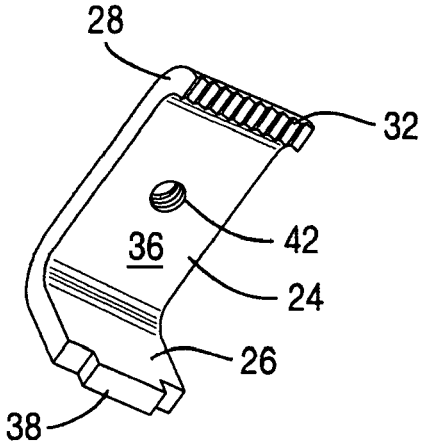
FIG. 8 is a perspective view of an alternative embodiment of the mounting bracket of the present invention shown including engaging teeth.
Figure 9:
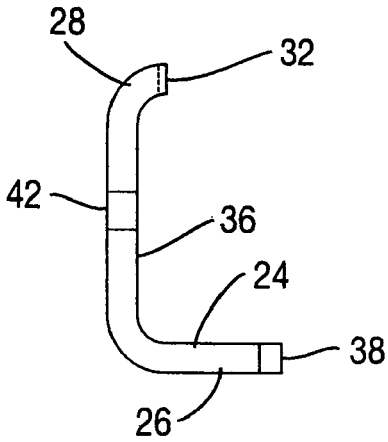
FIG. 9 is a side plan view of the embodiment of the mounting bracket shown in FIG. 8.
Figure 10:
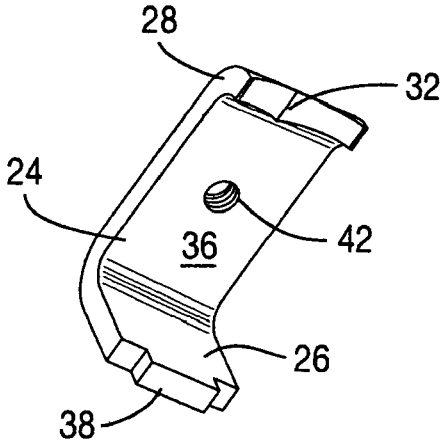
FIG. 10 is a perspective illustration of a further embodiment of a mounting bracket of the present invention including a toothed engaging enhancement means.
Figure 11:
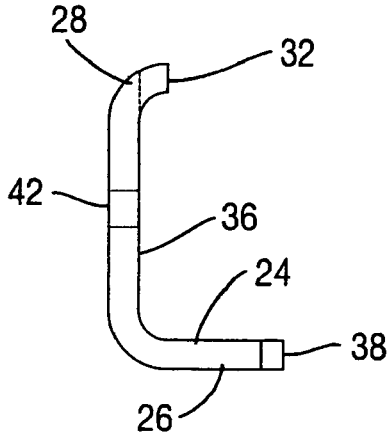
FIG. 11 is a side plan view of the embodiment shown in FIG. 10 of the mounting bracket.
Figure 14:
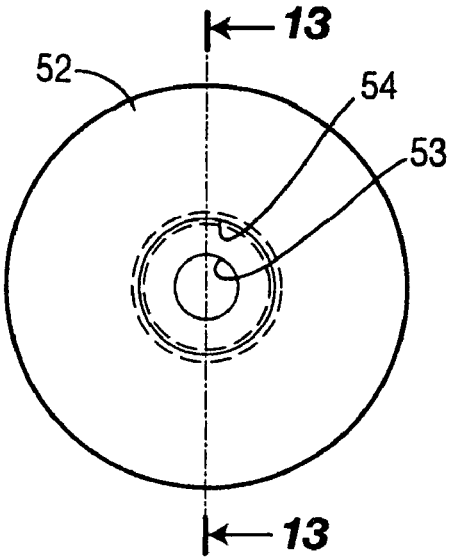
FIG. 14 is a top plan view of the embodiment of the conical washer shown in FIG. 12.
Figure 13:
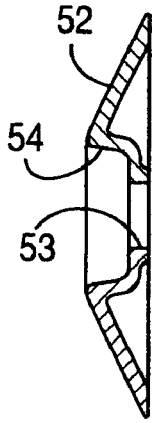
FIG. 13 is a side cross-sectional view of the embodiment of the conical washer shown in FIG. 12.
Figure 12:
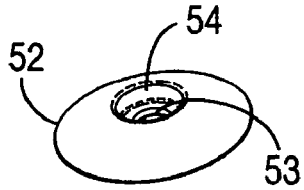
FIG. 12 is a perspective illustration of an embodiment of a conical washer for use with the engagement apparatus of the present invention.

In the preferred configuration shown in FIGS. 1, 2 and 3 the apparatus of the present invention is provided with four individual mounting brackets at spaced locations therearound. These include the first mounting bracket 66 and the second mounting bracket 74 and the third mounting bracket 82 and the fourth mounting bracket 90.

First mounting bracket 66 includes a first supporting section 68 with a first securement section 70 which defines a first retaining zone 72 adjacent to the rear surface 18 of the face plate 14. Similarly the second mounting bracket 74 defines a second supporting section 76 and a second securement section 78 with a second retaining zone 80 defined between the second securement section 78 and the rear surface 18 of the face plate 14.

Furthermore the third mounting bracket 82 includes a third supporting section 84 and a third securement section 86 which defines a third retaining zone 88 adjacent to the rear surface 18 of the face plate 14. Finally a fourth mounting bracket 90 includes a fourth supporting section 92 and a fourth securement section 94 which defines a fourth retaining zone 96 thereadjacent facing the rear surface 18 of the face plate 14. Thus these four individual mounting mechanisms will each include an individual engagement means extending through the flow slot 16 of the face plate 14 to which they are engaged. For this purpose a first engagement device 98 is engageable with respect to the first mounting bracket 66 and a second engagement device 100 is engageable with respect to the second mounting bracket 74 and a third engagement device 102 is engageable with respect to the third mounting bracket 82 and finally a fourth engagement device 104 is engageable with respect to a fourth mounting bracket 90.

One of the alternative constructions of the apparatus of the present invention is to include one or preferably two or even more of the flow slot means 16 in the face plate 14 as primary flow slots 106. Each primary flow slot 106 will be of a limited lateral dimension such that it is smaller than the width of the supporting section 26 of the mounting bracket 24 but includes a plurality of lateral slots 108 therein which are wide enough to receive the protruding tab 38. Thus the protruding tab 38 will extend into one of the lateral slots 108 with the supporting section 26 of the mounting bracket 24 in engagement with the rear surface 18 of the face plate 14 immediately adjacent the abutting flow slot 16. In this manner a plurality of individual discreet mounting locations will be defined at each of the laterally extending slots 108 in each of the primary flow slots 106. In the preferred configuration of the present invention as shown in FIGS. 1, 2 and 3 two such primary flow slots 106 can be included extending generally horizontally at the extreme opposite ends of the face plate 14.

The configuration of the flow slot means 16 in the face plate 14 can take a variety of different configurations but the preferred configuration is the one shown in FIGS. 1, 2 and 3 wherein the flow slots 16 extend in a radially directed array extending away from the lower open zone 64 such that each adjacent of the flow slots 16 is oriented at an acute angle with respect to each of the two adjacent flow slots. This provides a full flow capability while at the same time maximizing the ability of positioning of the mounting apparatus 22 of the present invention in any of the chosen flow slot means 16 of the face plate 14 in order to accommodate various different configurations and sizes of street storm drains 10 and curve inlet openings 12 defined therein.

It is important to appreciate that each of the flow slot means 16 and the face plate 14 of the present invention is capable of receiving the mounting apparatus 22 and, in particular, the mounting bracket 24 in engagement therewith while at the same time allowing a limited flow of fluid therethrough. The capability of attachment of the mounting apparatus 22 of the present invention with respect to any of the flow slots 16 is a distinct advantage over the prior art since it maximizes the capability of variable configurations and in this manner accommodates many different sizes, configurations and shapes of curved inlet openings 12 and street storm drains 10. In this manner the flow restricting member of the present invention is usable in a wide variety of specific applications.

A medallion 110 is preferably included with the present invention which can include various indicia 112 thereon in order to provide information to pedestrians regarding the "no dumping" aspects of the face plate and the fact that the materials which pass therethrough drain into public waterways. It is also an important characteristic of the present invention that the front surface of the face plate be capable of receiving indicia 114 thereon such as by laser engraving which provides additional information that no dumping is permitted and this is an economically enhanced face plate and that the materials that pass therethrough drain directly to the public waterways.

It is another important characteristic of the present invention that the apparatus from which the face plate 14 and the mounting brackets 24 are made is preferably of a weathering steel. Such steel will weather to a limited extent to cause a coating of rust to form thereover after which no further significant weathering occurs. This is a strong material which minimizes maintenance requirements and has been found to be particularly useful in regard to this application. Alternative materials such as stainless steel could also be employed for either the face plate or the brackets.

Figure 21:
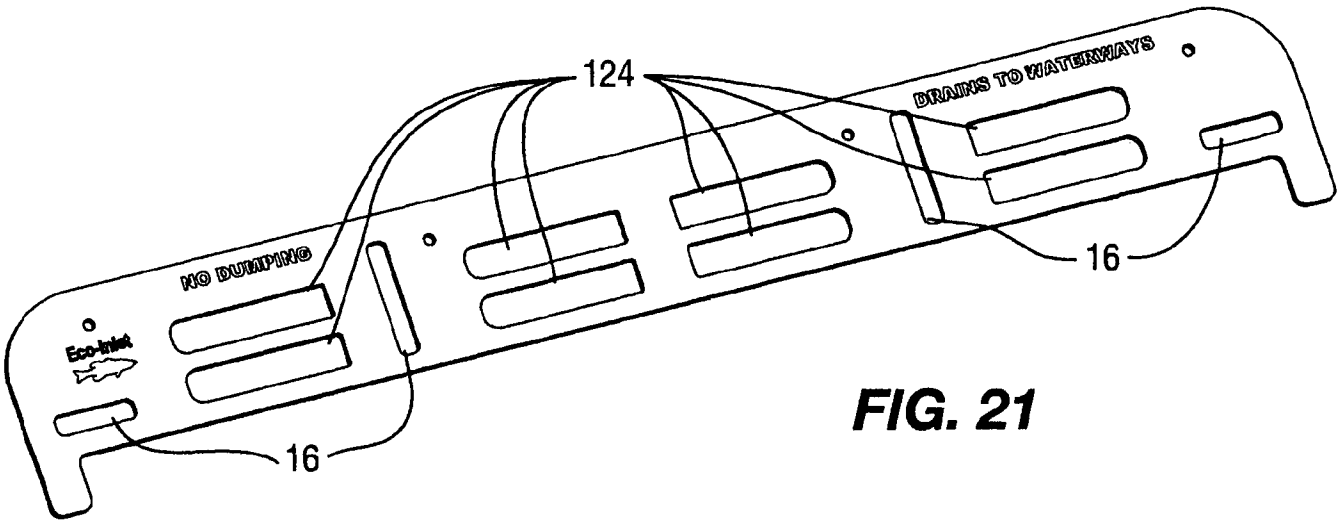
FIG. 21 is a front perspective illustration of an embodiment of an alternative face plate configuration usable with the present invention.
Figure 18:
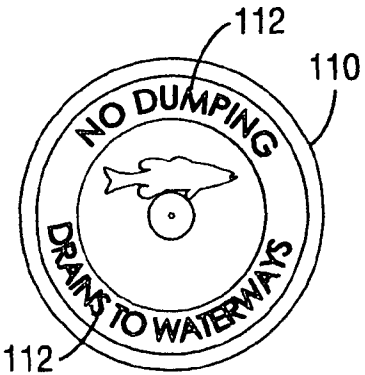
FIG. 18 is a top plan view of a medallion for use with the present invention.
Figure 19:
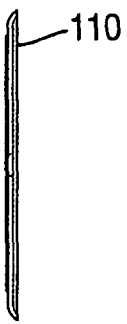
FIG. 19 is a side plan view of a medallion for use in the present invention.
Figure 20:
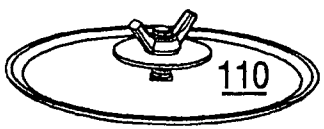
FIG. 20 is a rear plan view of the medallion shown in FIG. 18 showing the rear attachment wing nut and washer.

FIG. 21 shows an alternative possible configuration for the face plate 14 of the present invention. This particular embodiment shows a plurality of flow slots 16 and also includes a plurality of enlarged flow slots 124 extending horizontally. In particular, two rows of such horizontally oriented enlarged flow slots 124 are included in this configuration. A single horizontally extending row of such enlarged flow slots 124 is also within the contemplation of the present invention. With this design the mounting apparatus 22 will be attachable only with respect to selected ones of the face slot 16. In particular the enlarged flow slots 124 will be too large for attachment with respect to the mounting apparatus 22. It is understood in the present invention that the mounting apparatus 22 is engageable with respect to the face plate 14 at flow slots 16 defined therein. However, it should be appreciated that it is not necessary that the mounting apparatus 22 be securable with respect to each and every one of the flow slots 16 but can be purposely designed to be only engageable with respect to certain selected ones thereof. In particular, as shown in FIG. 21, two laterally located horizontal flow slots 16 are adapted to receive mounting apparatus 22 to engage therewith and two vertically oriented slots are similarly capable of being engaged by the mounting apparatus 22. However the enlarged flow slots 124 are too large and cannot be used for engaging of mounting apparatus 22 therewith.

Figure 16:
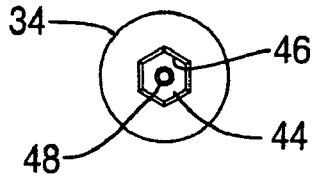
FIG. 16 is a side plan view of the embodiment of the stud shown in FIG. 15.
Figure 15:
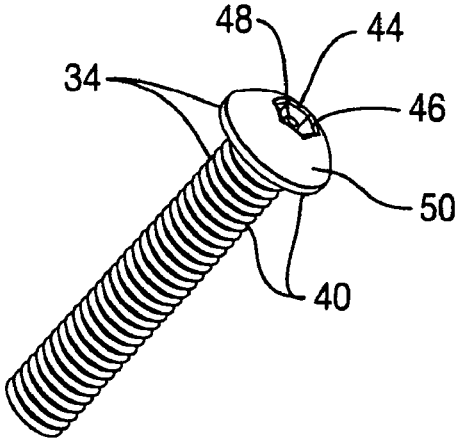
FIG. 15 is a perspective illustration of an embodiment of a fastening stud of the present invention shown with an allen wrench opening and a breakaway secure pin for providing securement security.
Figure 17:
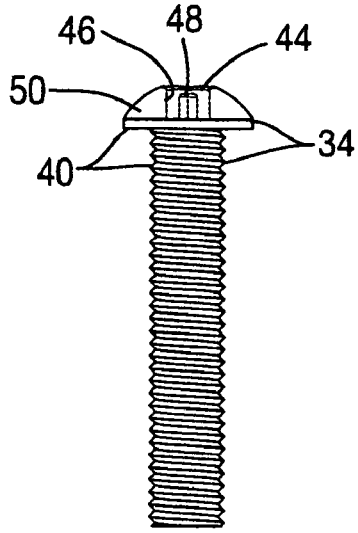
FIG. 17 is a top plan view of the embodiment of the stud shown in FIG. 15.
Figure 22:
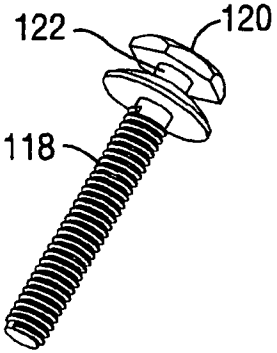
FIG. 22 is a front perspective illustration of an alternative fastener for use with the present invention showing a breakaway hex head connected to the fastener stud by a breakaway section.
Figure 23:
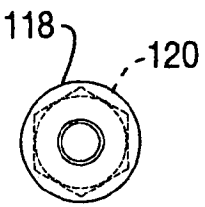
FIG. 23 is a top plan view of the embodiment of the fastener shown in FIG. 22.

FIGS. 22 and 23 show an alternative configuration for the fastener stud 40 of the present invention. This alternative fastener stud 118 design includes a breakaway hex or other shaped head 120 which includes a breakaway section 122 connecting the breakaway head section 120 to the body of the fastener. With this configuration, as the fasteners are rotated to the required torque specification, the breakaway section 122 will fracture causing the breakaway head section 120 to disengage from the body of the stud thereby providing an extremely secure security means 44 for preventing disengagement of the face plate 14 from the street storm drain 10. The configuration shown in FIGS. 22 and 23 should be considered to be an alternative to the security fastener stud design shown in FIGS. 15 through 17.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A flow restricting member for attachment to a street storm drain for positioning extending over a curb inlet opening defined therein which comprises:

A. a face plate defining a plurality of flow slot means extending therethrough, said flow slot means including at least one primary flow slot which defines a plurality of laterally extending slots defined therealong to facilitate engagement with respect thereto, said flow slot means in said face plate providing a restricted flow path therethrough into the curb inlet opening and facilitating attachment of said face plate with respect to the street storm drain extending over and adjacent the curb inlet opening defined therein for restricting flow therethrough, said face plate including:

(1) a rear surface facing the curb inlet opening and the street storm drain responsive to securement of said face plate with respect thereto;

(2) a front surface facing away from the street storm drain and the curb inlet opening responsive to securement of said face plate with respect thereto;

B. a mounting apparatus at least partially positionable extending through at least one of said flow slot means for engagement with respect to the street storm drain immediately surrounding the curb inlet opening defined therein and engageable with respect to at least one of said flow slots means defined in said face plate for retaining thereof in position extending over the curb inlet opening for restricting flow therethrough, said mounting apparatus including:

(1) a plurality of mounting brackets each including:

(a) a supporting section which is engageable with respect to one of said flow slot means defined in said face plate, said supporting section of at least one of said mounting brackets including a protruding tab means extending outwardly therefrom and adapted to extend into one of said laterally extending slots defined along said primary flow slot defined in said face plate to facilitate engagement of said supporting section therewith and prevent longitudinal movement of said supporting section along said primary flow slot;

(b) a securement section which is spatially disposed from said rear surface of said face plate to define therebetween a retaining zone for receiving and holding the street storm drain therewithin immediately surrounding the curb inlet opening defined therein for facilitating securement said face plate with respect thereto; and (2) an engagement means positioned extending through said flow slot means of said face plate into engagement with said mounting bracket means for urging said securement section thereof toward said rear surface of said face plate with the street storm drain surrounding the curb inlet opening positioned within said retaining zone for securement of said face plate with respect thereto.

2. A flow restricting member for attachment to a street storm drain for positioning extending over a curb inlet opening defined therein as defined in claim 1 wherein said mounting bracket defines an engagement section being engageable with respect to said engagement means extending through said flow slot means.

3. A flow restricting member for attachment to a street storm drain for positioning extending over a curb inlet opening defined therein as defined in claim 2 wherein said engagement section of said mounting bracket is positioned between said supporting section and said securement section thereof to facilitate mounting of said face plate to the street storm drain in position extending over the curb inlet opening defined therein.

4. A flow restricting member for attachment to a street storm drain for positioning extending over a curb inlet opening defined therein as defined in claim 1 wherein each of said mounting brackets is generally C-shaped.

5. A flow restricting member for attachment to a street storm drain for positioning extending over a curb inlet opening defined therein as defined in claim 1 wherein each of said mounting brackets is positioned generally behind said face plate adjacent said rear surface thereof.

6. A flow restricting member for attachment to a street storm drain for positioning extending over a curb inlet opening defined therein as defined in claim 1 wherein said supporting section of said mounting bracket is capable of adjustable engagement with respect to said flow slot means at a plurality of different locations therealong to facilitate attachment to street storm drains of various different sizes and configurations.

7. A flow restricting member for attachment to a street storm drain for positioning extending over a curb inlet opening defined therein as defined in claim 1 wherein each of said flow slot means is capable of maintaining restricted flow therethrough when a mounting bracket in positioned in engagement with one of said flow slot means for facilitating mounting of said face plate to a street storm drain.

8. A flow restricting member for attachment to a street storm drain for positioning extending over a curb inlet opening defined therein as defined in claim 1 wherein each of said engagement means includes a fastener stud extending through one of said flow slot means into engagement with respect to said mounting bracket to facilitate securement of the street storm drain immediately surrounding the curb inlet opening within said retaining zone.

9. A flow restricting member for attachment to a street storm drain for positioning extending over a curb inlet opening defined therein as defined in claim 8 wherein said mounting bracket defines a mounting aperture means therein adapted to receive said fastener stud extending therethrough to facilitate securement between said engagement means and said mounting bracket.

10. A flow restricting member for attachment to a street storm drain for positioning extending over a curb inlet opening defined therein as defined in claim 9 wherein said fastener stud is male threaded and wherein said mounting aperture means is female threaded and mated to said fastener stud to facilitate threaded engagement therebetween.

11. A flow restricting member for attachment to a street storm drain for positioning extending over a curb inlet opening defined therein as defined in claim 8 wherein said fastener stud includes a security means to prevent unauthorized disengagement thereof.

12. A flow restricting member for attachment to a street storm drain for positioning extending over a curb inlet opening defined therein as defined in claim 11 wherein said fastener stud defines an alien wrench opening means therein for facilitating rotational driving of said fastener stud and further defining a security pin positioned within said alien wrench opening means to prevent unauthorized disengagement thereof.

13. A flow restricting member for attachment to a street storm drain for positioning extending over a curb inlet opening defined therein as defined in claim 8 wherein said fastener stud includes a fastener head positionable on said front surface of said face plate and wherein said engagement means further includes a conical washer means defining a washer hole means extending therethrough, said washer hole means adapted to receive said fastener stud extending therethrough and said conical washer means adapted to extend around said fastener head for protection thereof adjacent said front surface of said face plate.

14. A flow restricting member for attachment to a street storm drain for positioning extending over a curb inlet opening defined therein as defined in claim 1 wherein said face plate further includes:

A. a first lateral end extending between said rear surface and said front surface of said face plate, said first lateral end being chamfered at an angle from said rear surface to said front surface laterally adjacent said face plate; and B. a second lateral end extending between said rear surface and said front surface of said face plate and positioned oppositely from said first lateral end, said second end edge being chamfered at an angle from said rear surface to said front surface laterally adjacent said face plate, said first lateral end and said second lateral end being chamfered inwardly toward one another extending forwarding from said rear surface of said face plate to said front surface thereof.

15. A flow restricting member for attachment to a street storm drain for positioning extending over a curb inlet opening defined therein as defined in claim 1 wherein said face plate further includes a lateral edge extending therearound between said rear surface and said front surface of said face plate, said first lateral edge being chamfered angularly from said rear surface to said front surface laterally adjacent said face plate such that said rear surface is larger in surface area than said front surface.

16. A flow restricting member for attachment to a street storm drain for positioning extending over a curb inlet opening defined therein as defined in claim 1 wherein said face plate and said mounting brackets are made of weathering steel which forms a protective layer of rust thereover after weathering.

17. A flow restricting member for attachment to a street storm drain for positioning extending over a curb inlet opening defined therein as defined in claim 1 wherein each of said mounting brackets is capable of engagement with respect to any one of said flow slot means.

18. A flow restricting member for attachment to a street storm drain for positioning extending over a curb inlet opening defined therein as defined in claim 1 wherein each of said flow slot means is capable of receiving one of said mounting brackets engageable therewith to facilitate mounting of said face plate with respect to the street storm drain extending over a curb inlet opening defined therein.

19. A flow restricting member for attachment to a street storm drain for positioning extending over a curb inlet opening defined therein as defined in claim 1 wherein said front surface of said face plate is positioned facing approximately oppositely from said rear surface thereof.

20. A flow restricting member for attachment to a street storm drain for positioning extending over a curb inlet opening defined therein as defined in claim 1 wherein said face plate includes a first leg means extending downwardly and a second leg means spatially disposed from said first leg means and extending downward, said first leg means and said second leg means defining a lower open zone therebetween to allow flow through the curb inlet opening of the street storm drain supplementing the flow through said flow slots means of said face plate, said first leg means and said second leg means also facilitating positioning of said face plate spatially disposed above street level therebelow.

21. A flow restricting member for attachment to a street storm drain for positioning extending over a curb inlet opening defined therein as defined in claim 1 wherein said mounting apparatus includes:

A. a first mounting bracket including:

(1) a first supporting section engageable with respect to one of said flow slot means defined in said face plate;

(2) a first securement section spatially disposed from said rear surface of said face plate to define therebetween a first retaining zone for receiving and holding the street storm drain therewithin immediately surrounding the curb inlet opening defined therein for facilitating securement said face plate with respect thereto;

B. a second mounting bracket including:

(1) a second supporting section engageable with respect to another one of said flow slot means defined in said face plate other than said flow slot means to which said first support section is engaged;

(2) a second securement section spatially disposed from said rear surface of said face plate to define therebetween a second retaining zone for receiving and holding the street storm drain therewithin immediately surrounding the curb inlet opening defined therein for facilitating securement said face plate with respect thereto;

C. a third mounting bracket including:

(1) a third supporting section engageable with respect to one of said flow slot means defined in said face plate other than those said flow slot means to which any of said first support section and said second support section are engaged;

(2) a third securement section spatially disposed from said rear surface of said face plate to define therebetween a third retaining zone for receiving and holding the street storm drain therewithin immediately surrounding the curb inlet opening defined therein for facilitating securement said face plate with respect thereto; and D. a fourth mounting bracket including:

(1) a fourth supporting section engageable with respect to another one of said flow slot means defined in said face plate other than those of said flow slot means to which any of said first support section and said second support section and said third support section are engaged;

(2) a fourth securement section spatially disposed from said rear surface of said face plate to define therebetween a fourth retaining zone for receiving and holding the street storm drain therewithin immediately surrounding the curb inlet opening defined therein for facilitating securement said face plate with respect thereto.

22. A flow restricting member for attachment to a street storm drain for positioning extending over a curb inlet opening defined therein as defined in claim 21 wherein said engagement means includes:

A. a first engagement device positioned extending through said flow slot means of said face plate to which said first supporting section of said first mounting bracket is engaged for engagement with respect to said first mounting bracket means for urging said first securement section thereof toward said rear surface of said face plate with the street storm drain surrounding the curb inlet opening positioned within said first retaining zone for securement of said face plate with respect thereto;

B. a second engagement device positioned extending through said flow slot means of said face plate to which said second supporting section of said second mounting bracket is engaged for engagement with respect to said second mounting bracket means for urging said second securement section thereof toward said rear surface of said face plate with the street storm drain surrounding the curb inlet opening positioned within said second retaining zone for securement of said face plate with respect thereto;

C. a third engagement device positioned extending through said flow slot means of said face plate to which said third supporting section of said third mounting bracket is engaged for engagement with respect to said third mounting bracket means for urging said third securement section thereof toward said rear surface of said face plate with the street storm drain surrounding the curb inlet opening positioned within said third retaining zone for securement of said face plate with respect thereto; and D. a fourth engagement device positioned extending through said flow slot means of said face plate to which said fourth supporting section of said fourth mounting bracket is engaged for engagement with respect to said fourth mounting bracket means for urging said fourth securement section thereof toward said rear surface of said face plate with the street storm drain surrounding the curb inlet opening positioned within said fourth retaining zone for securement of said face plate with respect thereto.

23. A flow restricting member for attachment to a street storm drain for positioning extending over a curb inlet opening defined therein as defined in claim 1 wherein each of said lateral slots defines a different location along said primary flow slot of said flow slot means for engagement of said supporting section of said mounting bracket therewith for facilitating attachment of said face plate at various difference locations in order to facilitate attachment thereof with respect to curb inlet openings of various different sizes and configurations.

24. A flow restricting member for attachment to a street storm drain for positioning extending over a curb inlet opening defined therein as defined in claim 1 wherein said flow slot means includes two of said primary flow slots to facilitate attachment of said face plate to a street storm drain around a curb inlet opening defined therein.

25. A flow restricting member for attachment to a street storm drain for positioning extending over a curb inlet opening defined therein as defined in claim 24 wherein each of said primary flow slots are oriented horizontally.

26. A flow restricting member for attachment to a street storm drain for positioning extending over a curb inlet opening defined therein as defined in claim 1 wherein said face plate defines said flow slots means extending radially upwardly and outwardly therewithin.

27. A flow restricting member for attachment to a street storm drain for positioning extending over a curb inlet opening defined therein as defined in claim 26 wherein each of said flow slot means are oriented at an acute angle with respect to each adjacent other of said flow slot means.

28. A flow restricting member for attachment to a street storm drain for positioning extending over a curb inlet opening defined therein as defined in claim 1 further comprising a medallion detachably securable with respect to said face plate, said medallion being capable of displaying indicia and text thereupon as desired.

29. A flow restricting member for attachment to a street storm drain for positioning extending over a curb inlet opening defined therein as defined in claim 1 wherein said face plate is adapted to receive indicia and text displayed thereon by laser engraving as desired.

30. A flow restricting member for attachment to a street storm drain for positioning extending over a curb inlet opening defined therein as defined in claim 9 wherein said fastener stud includes a fastener head thereon positionable on said front surface of said face plate, said engagement means further including a conical washer means defining a washer hole means extending therethrough, said washer hole means adapted to receive said fastener stud extending therethrough and said conical washer means adapted to extend around said fastener head for protection thereof adjacent said front surface of said face plate, said washer hole means of said conical washer means including an enlarged hole section to receive said fastener head therewithin responsive to said fastener stud extending through said washer hole means to facilitate protection of said engagement means to prevent disengagement of said face plate from said street storm drain around said curb inlet opening.

31. A flow restricting member for attachment to a street storm drain for positioning extending over a curb inlet opening defined therein as defined in claim 1 further comprising teeth means located on said securement section of said mounting bracket to facilitate engagement thereof with respect to the street storm drain around the curb inlet opening defined therein.

32. A flow restricting member for attachment to a street storm drain for positioning extending over a curb inlet opening defined therein as defined in claim 1 wherein said protruding tab means of said supporting section of at least one of said mounting brackets is smaller than the lateral width of said laterally extending slots defined in each of said laterally extending slots to facilitate extending of said protruding tab means into position within one of said laterally extending slots to facilitate engagement therebetween.

33. A flow restricting member for attachment to a street storm drain for positioning extending over a curb inlet opening defined therein as defined in claim 32 wherein each of said supporting sections having one of said protruding tabs means extending therefrom is larger than the lateral width of each of said laterally extending slots defined in said primary flow slot to facilitate engagement therewith.

34. A flow restricting member for attachment to a street storm drain for positioning extending over a curb inlet opening defined therein as defined in claim 1 wherein each of said protruding tabs means is laterally smaller than each of said flow slot means to facilitate engagement therebetween with said protruding tabs means extending thereinto and wherein each of said supporting sections of said mounting brackets is larger than the lateral width of each of said flow slot means to further facilitate engagement therewith.

35. A flow restricting member for attachment to a street storm drain for positioning extending over a curb inlet opening defined therein as defined in claim 1 wherein said laterally extending slots defined along said flow slot means are oriented approximately perpendicularly with respect thereto.

* * * * *

UNITED STATES PATENT AND TRADEMARK OFFICE

CERTIFICATE OF CORRECTION

PATENT NO. : 7,780,372 B2
APPLICATION NO. : 11/899851
DATED : August 24, 2010
INVENTOR(S) : James G. Fattori, Francis E. Loftus and Benjamin N. Steltzer It is certified that error appears in the above-identified patent and that said Letters Patent is hereby corrected as shown below:

In column 13, line 7, change "alien" to -- allen --.

In column 13, line 9, change "alien" to -- allen --.

Signed and Sealed this

Twenty-third Day of November, 2010

David J. Kappos

David J. Kappos
*Director of the United States Patent and Trademark Office*